US006447857B1

(12) United States Patent
Roberts et al.

(10) Patent No.: US 6,447,857 B1
(45) Date of Patent: Sep. 10, 2002

(54) BATON HANDLE SHOW POM

(76) Inventors: Kendall Ann Roberts, 2921 S. 125th E. Ave., Tulsa, OK (US) 74129; William R. Kampfe, 14516 E. 35TH St., Tulsa, OK (US) 74134

( * ) Notice: Subject to any disclaimer, the term of this patent is extended or adjusted under 35 U.S.C. 154(b) by 35 days.

(21) Appl. No.: 09/797,375

(22) Filed: Mar. 1, 2001

(51) Int. Cl.[7] ..... D04D 7/06

(52) U.S. Cl. ..... 428/4; 428/12; 428/28; D21/400; 446/243; 446/491

(58) Field of Search ..... 428/4, 12, 28; D21/400; 446/236, 243, 491; 16/111.1; 482/44, 45, 50

(56) References Cited

U.S. PATENT DOCUMENTS 4,055,840 A 10/1977 Uchytil et al.
4,786,535 A 11/1988 Young
5,079,046 A 1/1992 Kessler
5,130,169 A 7/1992 DeJaynes
5,234,725 A 8/1993 Smith
D401,419 S 11/1998 Hartmann et al.
D414,528 S 9/1999 Bocock et al.

*Primary Examiner*—Deborah Jones
*Assistant Examiner*—Abraham Bahta
(74) *Attorney, Agent, or Firm*—Molly D. McKay

(57) ABSTRACT

A show pom provided with a first set of streamers extending from the two ends of a baton handle and a second set of retractable streamers that retract within the ends of the hollow baton handle. The second set of streamers are usually constructed of a different color than the first set of streamers and are retracted into the baton handle so that the second set of streamers are not visible until they are deployed by spring action out the two ends of the baton handle by depressing a trigger pin provided on the baton handle.

6 Claims, 4 Drawing Sheets

BATON HANDLE SHOW POM

BACKGROUND OF THE INVENTION

1. Field of the Invention

The present invention relates to a baton handle show pom for use by cheerleaders. More specifically, the present invention is a show pom provided with a first set of streamers extending from the two ends of a baton handle and a second set of retractable streamers. The second set of streamers are usually constructed of a different color than the first set of streamers and are retracted into the baton handle so that the second set of streamers are not visible until they are deployed out the two ends of the baton handle by depressing a trigger pin provided on the baton handle.

2. Description of the Related Art

Cheerleaders use baton handle show poms in their cheerleading routines. Baton handle show poms are currently available with single or multiple color streamers permanently attached to the baton handle. However, none of the show poms currently available are provided with additional streamers that can be retracted so that they are not visible until deployed by the cheerleader.

The present invention provides a baton handle show pom with a first set of stationary streamers and a second set of retractable streamers that can be deployed instantaneously by the cheerleader by pressing a trigger pin provided on the baton handle. The retractable streamers are not visible when in their retracted position within the baton handle and are preferably constructed of a contrasting color to the stationary streamers so that the second set of streamers are immediately visible when deployed.

SUMMARY OF THE INVENTION

The present invention is a baton handle show pom provided with a first set of streamers secured to and extending outward from the two ends of a baton handle and a second set of retractable streamers. The second set of streamers are usually constructed of a different color material than the first set of streamers and are retracted into the baton handle so that the second set of streamers are not visible until they are deployed out the two ends of the baton handle by depressing a trigger pin provided on the baton handle. The second two streamers attach to opposite ends of a retractable pom shaft so that the second two streams are concealed within the baton handle when the retractable pom shaft is retracted telescopically into the two ends of the baton handle. The second set of streamers can be retracted back into the baton handle by pushing on both ends of the retractable pom shaft until the retractable pom shaft locks into its retracted position within the baton handle. When the retractable pom shaft locks into its retracted position, the trigger pin moves to its extended position, ready to be depressed again to deploy the retractable pom shaft and the attached second set of streamers out of the two ends of the baton handle.

DETAILED DESCRIPTION OF THE PREFERRED EMBODIMENT

The Invention

Figure 1:
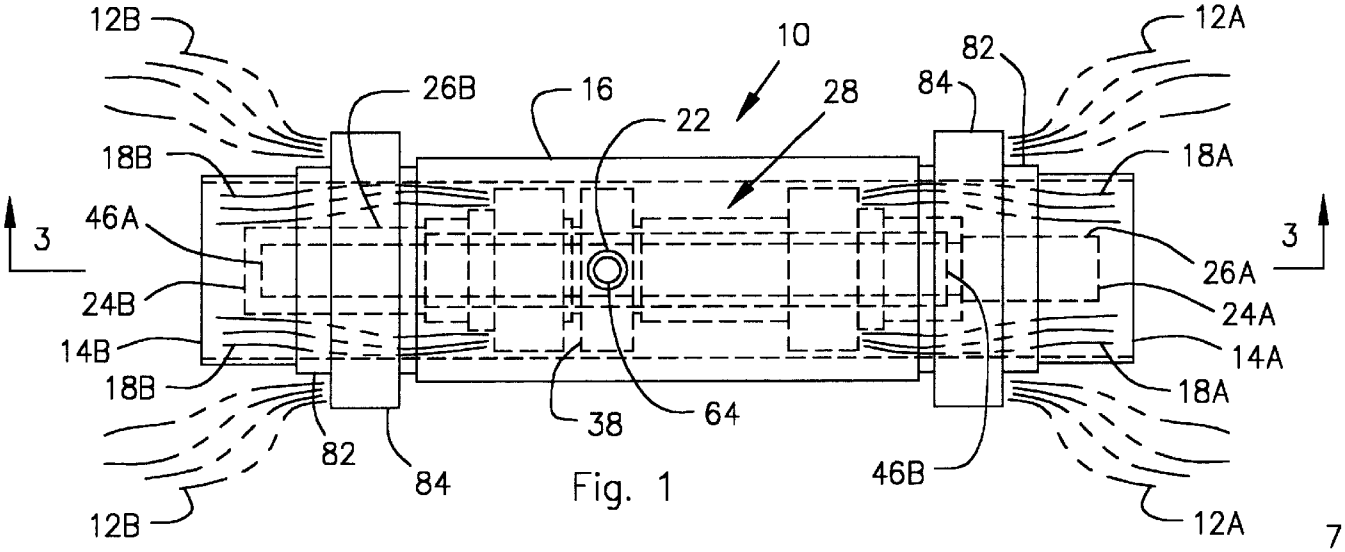
FIG. 1 is a top view of a baton handle show pom constructed in accordance with a preferred embodiment of the present invention, with the retractable pom shaft shown in outline in its retracted position within the baton handle.
Figure 2:
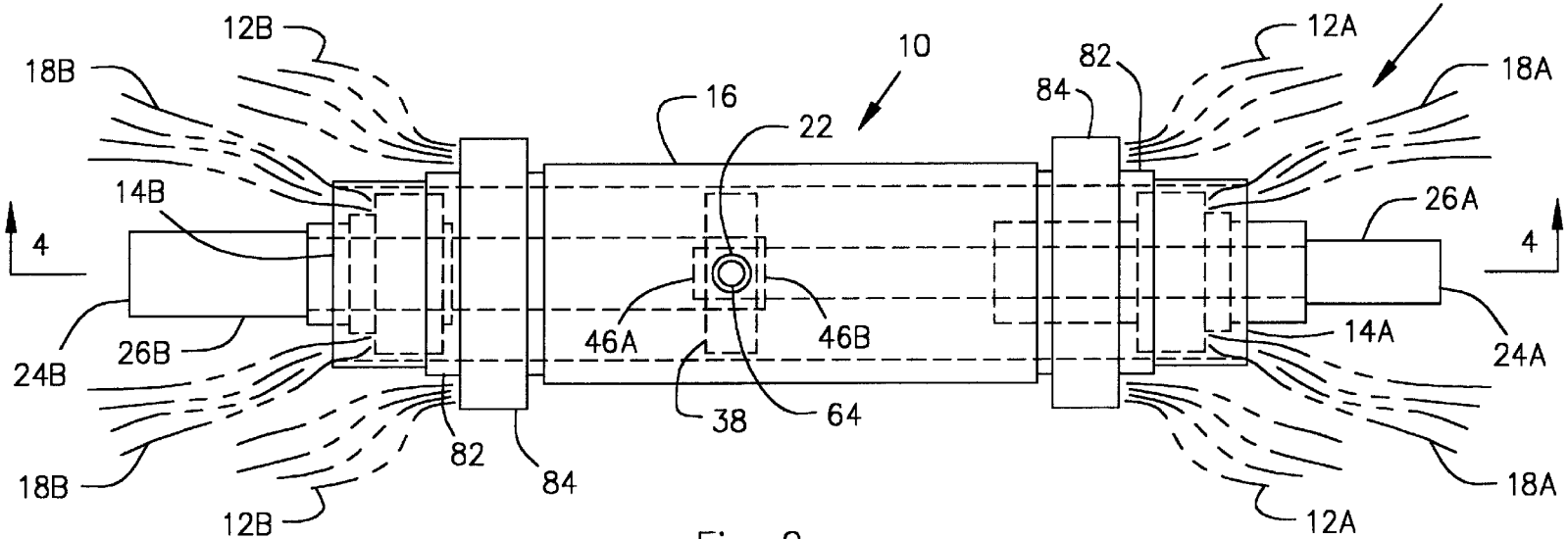
FIG. 2 is a top view of the baton handle show pom of FIG. 1 shown with the retractable pom shaft in its deployed position.

Referring now to FIGS. 1 and 2, there is illustrated a baton handle show pom 10 constructed in accordance with a preferred embodiment of the present invention. The show pom 10 has a first set of streamers 12A and 12B secured to and extending outward from the two ends 14A and 14B of a baton handle 16 and a second set of retractable streamers 18A and 18B. The second streamers 18A and 18B are usually constructed of a different color material than the first set of streamers 12A and 12B and are retractable into the baton handle 16 so that the second streamers 18A and 18B are not visible until they are deployed out the two ends 14A and 14B of a baton handle 16 by depressing a trigger pin 20 provided extending through an opening 22 in the baton handle 16. By extending through opening 22, the trigger pin 20 also serves to hold a retractable pom shaft 26 within the baton handle 16.

Figure 3:
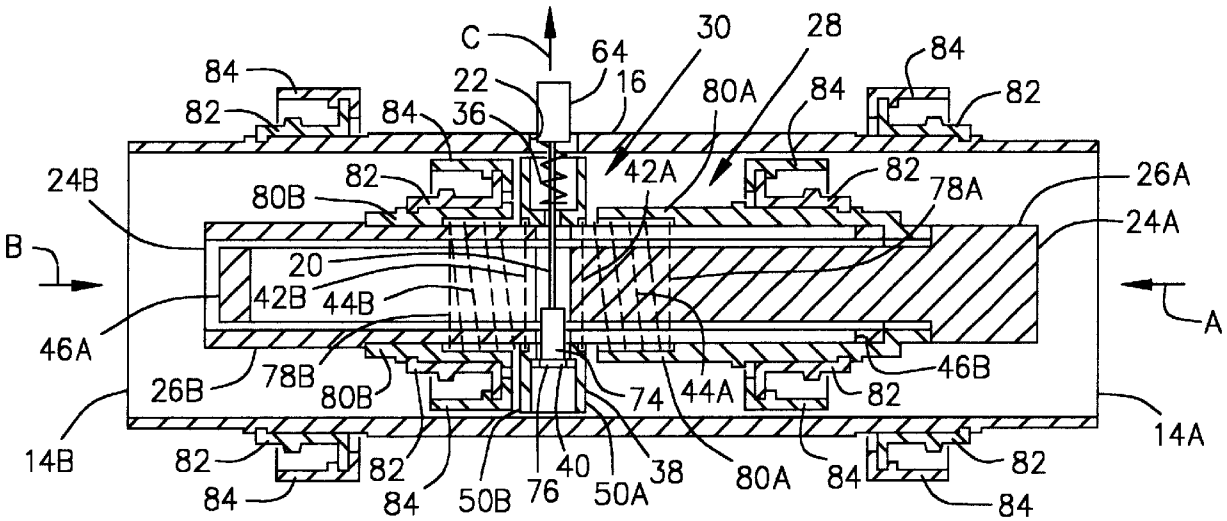
FIG. 3 is a cross sectional view of the baton handle show pom of FIG. 1 taken along line 3—3 shown with the streamers removed.
Figure 4:
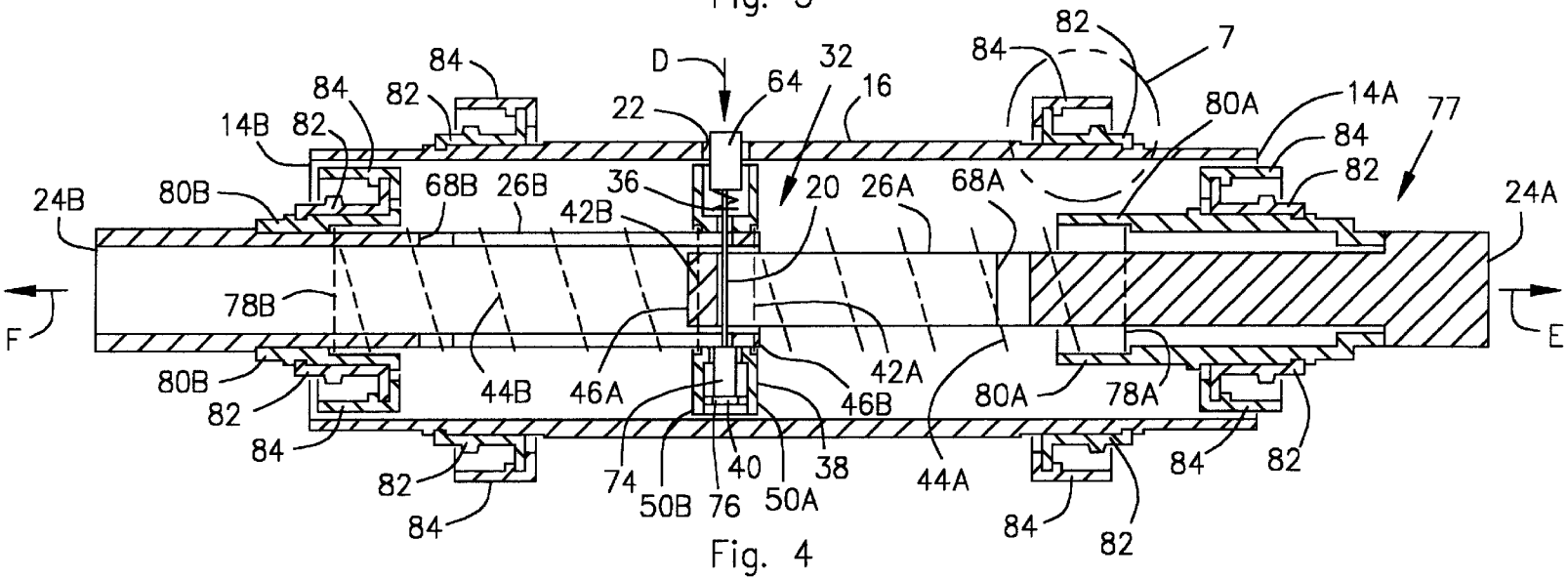
FIG. 4 is a cross sectional view of the baton handle show pom of FIG. 2 taken along line 4—4 shown with the streamers removed.

The second streamers 18A and 18B attach to opposite ends 24A and 24B of the retractable pom shaft 26. Referring now to FIGS. 3 and 4 which illustrate the show pom 10 with the streamers 12A, 12B, 18A and 18B removed, the retractable pom shaft 26 consists of an inner pom shaft 26A that is telescopically received within an outer pom shaft 26B. The retractable pom shaft 26 is telescopically received into the two ends 14A and 14B of a baton handle 16. The second set of streamers 18A and 18B can be retracted back into the baton handle 16, as shown in FIG. 1, by pushing on both ends 24A and 24B of the retractable pom shaft 26 in the directions shown by Arrows A and B in FIGS. 3 and 8, until the retractable pom shaft locks 26 into its retracted position 28 within the baton handle 16, as illustrated in FIGS. 1 and 3. As best illustrated in FIG. 3, when the retractable pom shaft 26 locks into its retracted position 28, the trigger pin 20 moves to its extended or locked position 30, ready to be depressed again to its unlocked position 32, as illustrated in FIG. 4, to deploy the retractable pom shaft 26 and the attached second set of streamers 18A and 18B out of the two ends 14A and 14B of the baton handle 16.

Figure 5:
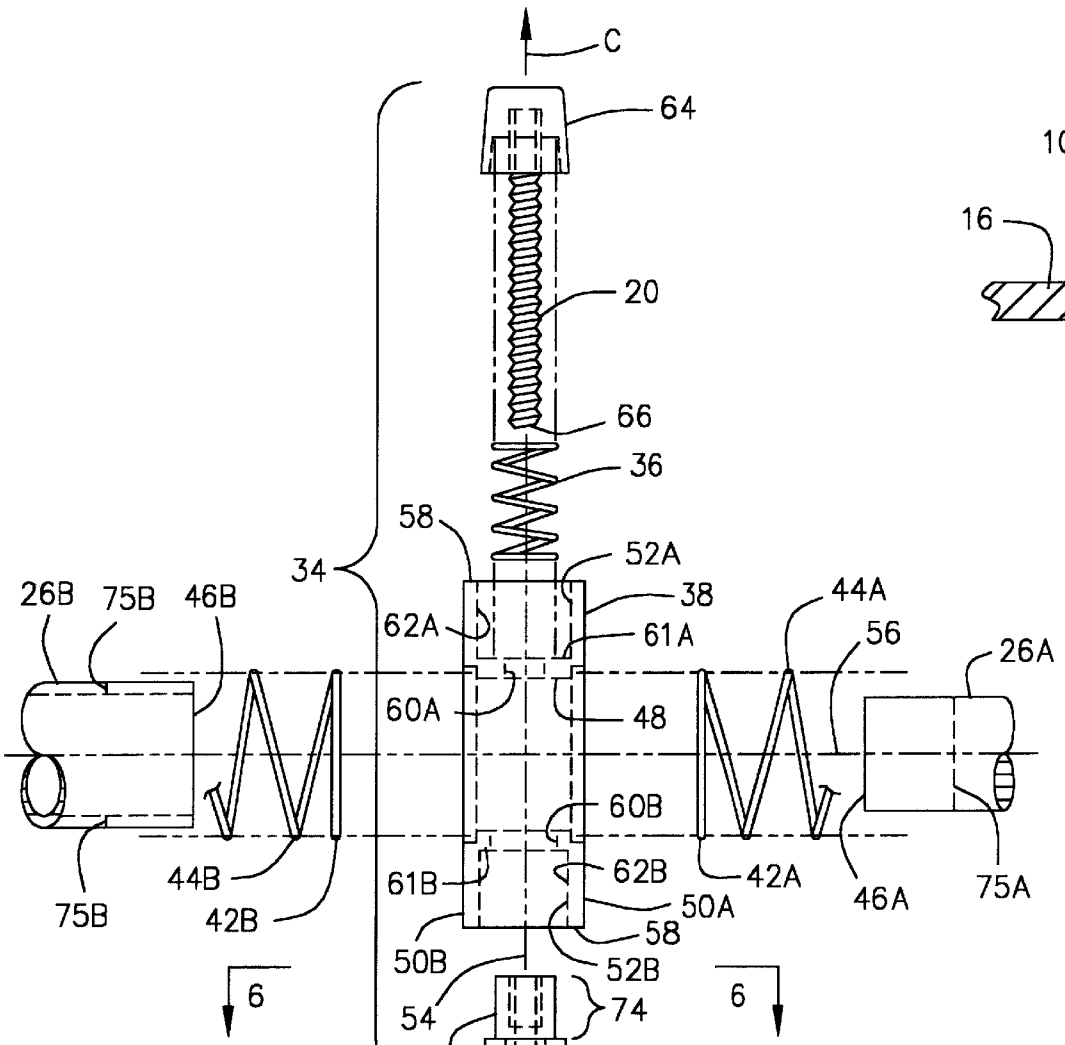
FIG. 5 is a exploded view of the trigger pin assembly shown in association with an inner pom shaft and an outer pom shaft of the retractable pom shaft and with an pair of extension springs.

Referring now to FIG. 5, the details of the trigger pin assembly 34 are illustrated. The trigger pin assembly 34 consists of the trigger pin 20, a reset spring 36, a bulkhead 38, and a trigger nut 40. FIG. 5 shows the trigger pin assembly 34 in association with proximal ends 42A and 42B of two extension springs 44A and 44B and in association with proximal ends 46A and 46B of the inner pom shaft 26A and the outer pom shaft 26B, respectively.

The bulkhead 38 is provided with a central opening 48 extending through a central portion of the circular bulkhead 38 so that the central opening 48 extends between two flat sides 50A and 50B of the circular bulkhead 38, and the central opening 48 is large enough to slideably receive the proximal end 42B of the hollow outer pom shaft 26B therethrough. The proximal end 46B of the outer pom shaft 26B is open and is large enough so that it slideably receives in telescoping fashion the proximal end 46A of the solid inner pom shaft. The central opening 48 is enlarged adjacent to each of the two flat sides 50A and 50B so as to form a shoulder on each side of the bulkhead that receives the proximal ends 42A and 42B of the extension springs 44A and 44B.

The bulkhead 38 is also provided with a pair of pin openings 52A and 52B therethrough that are aligned with each other along an axis 54 that is perpendicular to and axis 56 of the central opening 48 so that each pin opening 52A and 52B extends from the perimeter 58 of the circular dimension of the bulkhead 38 to the central opening 48. The first pin opening 52A is provided with a reduced diameter portion 60A that terminates at the central opening 48 and a larger diameter portion 62A that terminates at the perimeter 58, with a shoulder 61A formed at the junction of the reduced diameter portion 60A and the larger diameter portion 62A. Likewise, the second pin opening 52B is provided with a reduced diameter portion 60B that terminates at the central opening 48 and a larger diameter portion 62B that terminates at the perimeter 58, with a shoulder 61B formed at the junction of the reduced diameter portion 60B and the larger diameter portion 62B. The larger diameter portion 62A is cylindrical so that it slidably receives a cylindrical trigger head 64 of the trigger pin 20. The trigger pin 20 is provided with a threaded bolt end 66 that extends through the reset spring 36 and captures the reset spring between the trigger head 64 and the shoulder 61A, thus biasing the trigger head 64 outward, as indicated by Arrow C in FIGS. 3 and 5.

Referring now to FIGS. 8, 9, 10 and 11, the inner pom shaft 26A solid and is provided with a circular pin opening 68A extending therethrough along an axis 70A. Axis 70A is perpendicular to and intersects with the longitudinal axis 56 that is also the longitudinal axis of the retractable pom shaft 26. The circular pin opening 68A connects to a slot 72A provided in the inner pom shaft 26A, and the slot 72A extends along the longitudinal axis 56.

The outer pom shaft 26A is hollow and likewise is provided with a pair of circular pin openings 68B extending through each of the walls of the outer pom shaft 26A so that the circular pin openings 68B align along an axis 70B. Each of the circular pin openings 68B connects to one of a pair of slots 72B provided in the walls of the outer pom shaft 26B so that the slots 72B are parallel to the longitudinal axis 56. The circular pin openings 68A and 68B are sufficiently large to slideably receive a cylindrical portion 74 of the trigger nut 40 and the slots 72A and 72B align with each other to slideably receive the threaded bolt end 66 of the trigger pin 20. The cylindrical portion 74 of the trigger nut 40 is internally threaded to secure to the threaded bolt end 66 of the trigger pin 20.

Figure 11:
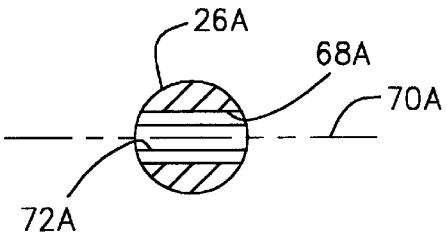
FIG. 11 is a cross sectional view of the inner pom shaft taken along line 11—11.
Figure 10:
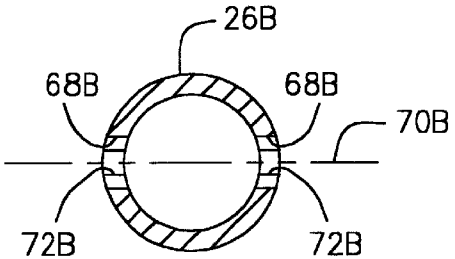
FIG. 10 is a cross sectional view of the outer pom shaft taken along line 10—10.

As shown in FIG. 11, the slot 72A provided in the inner pom shaft 26A is slightly smaller in diameter than its associated circular pin opening 68A. Also, as shown in FIG. 10, the slot 72B provided in the outer pom shaft 26B is slightly smaller in diameter than its associated circular pin opening 68B. The slots 72A and 72B are too small to accommodate the cylindrical portion 74 of the trigger nut 40, but are sufficiently large to allow the slots to move relative to the threaded bolt end 66 of the trigger pin 20 which extends therethrough. Each of the slots 72A and 72B is closed ended at the end 75A or 75B of the slot opposite the circular pin opening 68A or 68B. With the ends 75A and 75B closed, the threaded bolt end 66 of the trigger pin 20 is captured within the slots 72A and 72B and the trigger pin 20 prevents the inner and outer pom shafts 26A and 26B from separating from each other and prevents the ends 24A and 24B from moving out of the baton handle 16 beyond the deployed position 77, as illustrated in FIGS. 2 and 4. Thus, the inner pom shaft 26A is slides within the hollow outer pom shaft 26B that telescopically receives it. Th trigger pin 20 holds the inner and outer pom shafts 26A and 26B together so that they can not disengage from each other.

Figure 6:
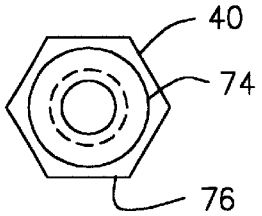
FIG. 6 is an end view of the trigger nut of FIG. 5 taken along line 6—6.

Referring now again to FIG. 5 and also to FIG. 6, the reduced diameter portion 60B of the second pin opening 52B is cylindrical and sufficiently large so that the cylindrical portion 74 of the trigger nut 40 can slide through the reduced diameter portion 52B, since the reset spring 36 biases the trigger pin 20 and the attached trigger nut 40 in the direction of Arrow C. When the cylindrical portion 74 of the trigger nut 40 engages the circular pin openings 68A and 68B, as illustrated in FIG. 3, this locks the retractable pom shaft 26 in its retracted or locked position 28. The larger diameter portion 62B of the second pin opening 52B is hexagonal in shape and sufficiently large to slideably receive a hexagonal head 76 of the trigger nut 40, with the shoulder 61B preventing the hexagonal head 76 from entering the reduced diameter portion 60B and the hexagonal shaped larger diameter portion 62B preventing the trigger nut 40 from rotating within the second pin opening 52B. The shoulder 61B limits the depth that the cylindrical portion 74 can enter into the central opening 48 of the trigger pin assembly 34.

When a cheerleader depresses the cylindrical trigger head 64 that extends through opening 22 in the baton handle 16, as illustrated by Arrow D in FIG. 4, the cylindrical portion 74 of the trigger nut 40 disengages from the circular pin openings 68A and 68B and reenters to the pin opening 52B. When the cylindrical portion disengages circular pin openings 68A and 68B, the opposite ends 24A and 24B of a retractable pom shaft 26 are forced outward by extension springs 44A and 44B. As previously described, the proximal ends 42A and 42B of the extension springs 44A and 44B engage the bulkhead 38 at the central opening 48. A distal end 78A of the first extension spring 44A is captured within a spring retainer 80A provided on the distal end 24A of the inner pom shaft 26A and a distal end 78B of the second extension spring 44B is captured within a spring retainer 80B provided on the distal end 24B of the outer pom shaft 26B. Thus, extension springs 44A and 44B bias the ends 24A and 24B of the retractable pom shaft outward, as illustrated by Arrows E and F in FIGS. 4 and 9.

Each streamer 12A, 12B, 18A, and 18B is secured to the show pom by means of a collar assembly comprised of a first collar piece 82 and a second collar piece 84. Since all of the streamers attach to the baton handle show pom 10 is the same way, attachment of only streamer 12A is illustrated in detail in FIG. 7. The first collar piece 82 secures to one of the two ends 14A and 14B the baton handle 16 or to one of the two ends 24A or 24B of the retractable pom shaft 26, depending on the streamer 12A, 12B, 18A, and 18B that is to be attached. The first collar piece 82 is provided with an inwardly extending collar lip 86 that engages an indented ring 88 in order to secure the first collar piece 82 to the baton handle show pom 10. An indented ring 88 is provided for this purpose encircling each of the two ends 14A and 14B of the baton handle 16 and encircling each of the two ends 24A or 24B of the retractable pom shaft 26. A spaced apart pair of shoulders 90A and 90B is provided on each of the two ends 14A and 14B of the baton handle 16 and on each of the two ends 24A or 24B of the retractable pom shaft 26 so that a pair of these shoulders 90A and 90B surround each indented ring 88. The shoulders 90A and 90B aid in positioning the first collar piece 82 so that it properly engages the indented ring 88 with its associated lip 86 and aid in holding the first collar piece 82 on the baton handle show pom 10 at the proper location.

Figure 7:
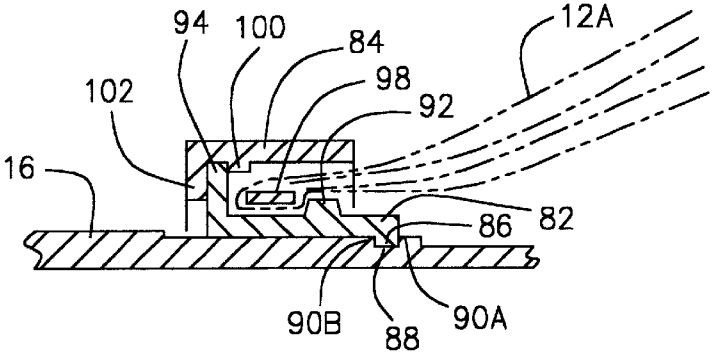
FIG. 7 is an enlarged view of the pom mounting assembly of FIG. 4 taken from within the area encircled by line 7 shown with the streamer attached.

As illustrated in FIG. 7, the first collar piece 82 is provided with an outwardly extending retainer lip 92 and an outwardly extending locking lip 94 so that a space 96 is defined between the retaining lip 92 and the locking lip 94. The streamer 12A is constructed of a plurality of individual streamer strands 96 that are doubled back on themselves around a retaining ring 98 so that retaining ring is positioned approximately midway along the length of each of the strands 96. After the plurality of strands 96 are thus attached around the retaining ring, the retaining ring 98 is then positioned so that the retaining ring 98 lies in the space 96 and the strands 96 extend away from the locking lip 94.

The second collar piece 84 is then slipped over the first collar piece 82 so that a first locking shoulder 100 provided on the second collar piece 84 slides past the locking lip 94 of the first collar piece 82. This captures the locking lip 94 between the first locking shoulder 100 and a second locking shoulder 102 provided on the second collar piece 84. The two locking shoulders 100 and 102 are spaced apart from each other on the second collar piece 84 a sufficient distance to allow the locking lip 94 to be accommodated between the shoulders 100 and 102. This also secures the second collar piece 84 to the first collar piece 82 and secures the retaining ring 98 and strands 96 of the streamer 12A, 12B, 18A, or 18B between the first and second collar pieces 82 and 84, thereby securing the streamer 12A, 12B, 18A, or 18B to the baton handle show pom 10.

Operation of the Invention

Figure 8:
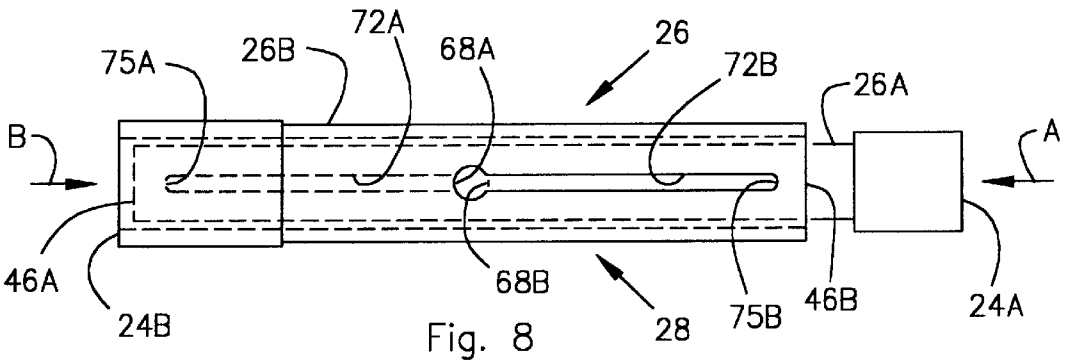
FIG. 8 is top view of the retractable pom shaft of Figure shown with the inner and outer pom shafts retracted so that the round opens provided in each of the inner and outer pom shafts aligned with each other.
Figure 9:
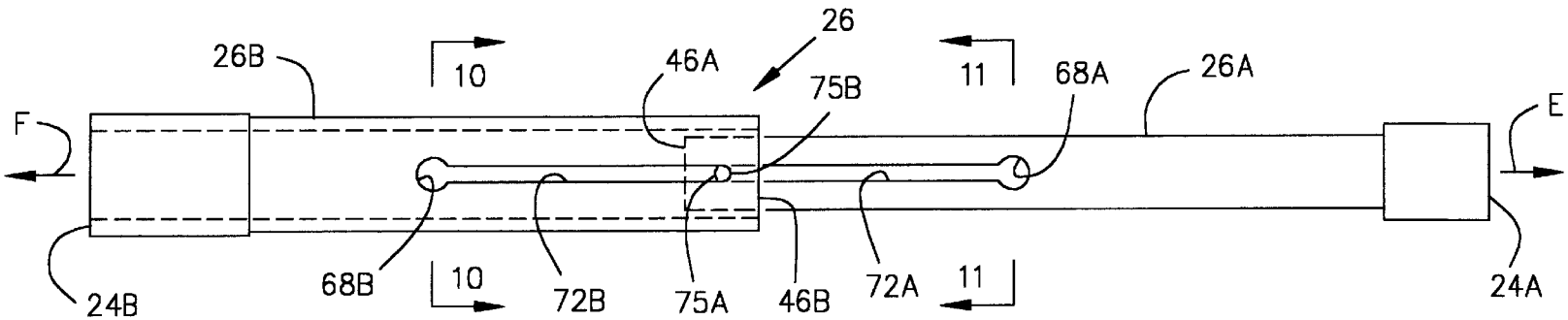
FIG. 9 is a top view of the retractable pom shaft of FIG. 8 shown with the inner and outer pom shafts deployed.

Referring to FIGS. 2 and 4, the baton handle show pom 10 is shown in its deployed position 77. In order to relock the pom 10 in its retracted position 28 the cheerleader pushes inward simultaneously on both the ends 24A and 24B until the circular pin openings 68A and 68B are aligned, as illustrated in FIG. 8. When the circular pin openings 68A and 68B are thus aligned, the reset spring 36 pulls the cylindrical portion 74 of the trigger nut 40 into the circular pin openings 68A and 68B, placing the trigger pin 20 into the locked position 30 of FIG. 3, with the trigger head 64 raised out of the opening 22. The retractable pom shaft 26 will remain in this retraced position 28 until the trigger head 64 is depressed, moving the trigger pin 20 to its unlocked position 32. Once the cylindrical portion 74 of the trigger nut 40 disengages the circular pin openings 68A and 68B, the inner and outer pom shafts 26A and 26B will be pushed outward by the extension springs 44A and 44B until the closed ends 75A and 75B of the slots 72A and 72B encounter the trigger pin 20 and the retractable pom shaft 26 arrives at the deployed position 77 illustrated in FIGS. 2, 4, and 9. As the retractable pom shaft 26 moves from the retracted position 28 to the deployed position 77, the retractable streamers 18A and 18B move out of the hollow interior of the baton handle 16 where they are not visible into the center portion of the first set of streamers 12A and 12B where they are visible. The visibility of the retractable streamers 18A and 18B is enhanced by constructing them of a different color material than the first set of streamers 12A and 12B. It also may be desirable to construct the retractable pom shaft 26 from a material that is the same color as the retractable streamers 18A and 18B.

Although not illustrated, it is possible to make baton handle show poms using the teaching of the present invention to simultaneously deploy more than one set of retractable streamers which could be constructed of various contrasting colors, deploy multiple sets of contrasting colored streamers at different times during a cheerleading routine, deploy streamers of different lengths, or deploy streamers or other objects that do not attach to the baton handle show pom.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A baton handle show pom comprising:

a hollow baton handle with one streamer of a first pair of streamers secured to each of the two ends of the baton handle, and a retractable pom shaft with one streamer of a second pair of streamers secured to each of the two ends of the retractable pom shaft, said retractable pom shaft telescopically received within said baton handle so the second set of streamers are not visible when the ends of the retractable pom shaft are retracted within the baton handle and the second set of streamers are visible at the two ends of the baton handle when the retractable pom shaft is deployed so that the ends of the retractable pom shaft extend out of the ends of the baton handle.

2. A baton handle show pom according to claim 1 further comprising:

said retractable pom shaft spring biased to deploy the second set of streamers out the two ends of the baton handle when a trigger pin that holds the retractable pom shaft in a retracted position is depressed.

3. A baton handle show pom according to claim 1 further comprising:

said retractable pom shaft comprised of an inner pom shaft and a hollow outer pom shaft, said outer pom shaft telescopically receiving said inner pom shaft within the hollow outer pom shaft, said inner pom shaft normally spring biased outward through one end of said baton handle and said outer pom shaft normally spring biased outward through the other end of said baton handle.

4. A baton handle show pom according to claim 3 further comprising:

said inner pom shaft and said outer pom shaft each being spring biased from a trigger assembly that secures within said hollow baton handle to hold the retractable pom shaft within the baton handle, said trigger assembly provided with a central opening through which the inner pom shaft and outer pom shaft extend.

5. A baton handle show pom according to claim 4 further comprising: each said inner pom shaft and said outer pom shaft being provided with a longitudinal slot therethrough that intersects with a circular pin opening also extending therethrough, a trigger pin movably provided on said trigger assembly and extending through the slots in both the inner and outer poms so that the inner and outer poms slide along the trigger pin as they are retracted and deployed, a trigger nut removably attached to one end of said trigger pin, said trigger nut provided with a cylindrical portion, said cylindrical portion removably engages the circular pin openings of the inner and outer pom shafts when the ends of the retractable pom shaft are pushed inward so that the circular pin openings are aligned in order to lock the retractable pom shaft in a retracted position.

6. A baton handle show pom according to claim 5 further comprising:

a trigger head provided attached to a second end of said trigger pin and spring biased away from said trigger nut, said trigger head extending through an opening in the baton handle so that the cylindrical portion of said trigger nut disengages from the circular pin openings of the inner and outer pom shafts when the trigger head is depressed thus unlocking the inner and outer pom shafts so that the retractable pom shaft is deployed.

* * * * *